US005361678A

United States Patent [19]

Roopchand et al.

[11] Patent Number: 5,361,678

[45] Date of Patent: Nov. 8, 1994

[54] COATED CERAMIC BODIES IN COMPOSITE ARMOR

[75] Inventors: Brijmohan J. Roopchand; David I. Yun, both of Murrysville; Douglas E. Marinaro, Trafford; Mary E. Hyland, Oakmont, all of Pa.

[73] Assignee: Aluminum Company of America, Pittsburgh, Pa.

[21] Appl. No.: 410,413

[22] Filed: Sep. 21, 1989

[51] Int. Cl.[5] ..... F41H 5/04

[52] U.S. Cl. ..... 89/36.02; 109/84; 164/100

[58] Field of Search ..... 89/36.02; 109/84; 164/100, 101, 102; 428/614, 911

[56] References Cited

U.S. PATENT DOCUMENTS

| | | | |
|---|---|---|---|
| 1,703,417 | 2/1929 | Donaldson | 109/84 |
| 3,705,558 | 12/1972 | McDougal et al. | 109/84 |
| 3,874,855 | 4/1975 | Legrand | 109/84 |
| 3,977,294 | 8/1976 | Jahn | 89/36.02 |
| 4,534,266 | 8/1985 | Huet | 89/36.02 |
| 4,696,240 | 9/1987 | Maxeiner | 109/82 |
| 4,900,599 | 2/1990 | Doble | 428/616 |

FOREIGN PATENT DOCUMENTS

| | | | |
|---|---|---|---|
| 1318351 | 5/1973 | United Kingdom | 89/36.02 |

*Primary Examiner*—Stephen C. Bentley
*Attorney, Agent, or Firm*—Glenn E. Klepac

[57] ABSTRACT

Lightweight composite armor comprising a plurality of ceramic bodies embedded in a metal matrix. The ceramic bodies are preferably generally spherical alumina balls coated with a binder and ceramic particles. A particularly preferred coating comprises titanium dioxide and barium sulfate particles suspended in an aqueous sodium silicate solution at a thickness of about 0.76–1.5 mm.

20 Claims, 3 Drawing Sheets

COATED CERAMIC BODIES IN COMPOSITE ARMOR

FIELD OF THE INVENTION

The present invention relates to composite armor comprising a metal matrix and a plurality of ceramic bodies embedded in the matrix. More particularly, the invention pertains to composite armor comprising a metal matrix and ceramic bodies having an adhered coating in order to facilitate manufacture and to improve performance of the finished product.

BACKGROUND OF THE INVENTION

Composite armor plate comprising a mass of spherical ceramic balls distributed in an aluminum alloy matrix is known in the prior art. However, such prior art composite armor plate suffers from one or more serious disadvantages making it difficult to manufacture and less than entirely suitable for the purpose of defeating metal projectiles.

For example, McDougal et al U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel coated alumina spheres to an aluminum alloy plate by means of a polysulfide adhesive.

Composite armor plate as described in the McDougal et al patent is difficult to manufacture because the ceramic spheres may be damaged by thermal shock arising from molten metal contact. The ceramic spheres are also sometimes displaced during casting of molten metal into interstices between the spheres.

In order to minimize such displacement, Huet U.S. Pat. No. 4,534,266 proposes a network of interlinked metal shells to encase ceramic inserts during casting of molten metal. After the metal solidifies, the metal shells are incorporated into the composite armor.

It is a principal objective of the present invention to provide composite armor with enhanced protection against penetration by projectiles.

A related objective of the present invention is to provide a coating for ceramic bodies in composite armor that reduces damage from thermal shock during manufacture and enhances resistance of the armor to penetration by projectiles.

An additional objective of the invention is to provide a method for manufacturing the improved composite armor.

Additional objectives and advantages of the present invention will become apparent to persons skilled in the art from the following detailed description of our invention.

SUMMARY OF THE INVENTION

In accordance with the present invention, there is provided lightweight composite armor comprising a metal matrix, a plurality of ceramic bodies embedded in the matrix, and a coating adhered to at least one of the ceramic bodies. The metal matrix preferably comprises an aluminum or titanium alloy, more preferably an aluminum alloy of the 2000, 5000, 6000, or 7000 Aluminum Association Series. The useful aluminum alloys include 2024, 2124, 5052, 5154, 6009, 6010, 6111, 6013, 6061, 6063, 7050, and 7075. Aluminum alloys of the 6000 Series are particularly preferred.

The ceramic bodies may be tiles or generally spherical balls. Their composition may include any of a number of hard ceramic substances. Such substances include aluminum oxide, boron carbide, titanium diboride, and silicon carbide. Spheres comprising predominantly alpha-alumina (corundum) are particularly preferred.

The ceramic bodies are coated with a thick paste comprising a binder and a plurality of suspended ceramic particles. The binder is preferably sodium silicate in aqueous solution having a pH of greater than about 10.

The ceramic particles in the paste have an average size of less than about 200 microns, preferably less than about 100 microns and more preferably about 1–25 microns. The particles may comprise alumina, silica, talc, titanium dioxide, barium sulfate, other particulate ceramic materials or mixtures thereof. A mixture of titanium dioxide and barium sulfate particles is particularly preferred.

The coating has a thickness of about 10–80 mils (0.25–2.0 mm). A coating thickness of about 30–60 mils (0.76–1.5 mm) is more preferred. The ceramic bodies are preferably precoated with the paste and dried before insertion into a mold. Alternatively, the ceramic bodies may be spray coated in situ after being positioned in the mold.

DETAILED DESCRIPTION OF A PREFERRED EMBODIMENT

In a preferred embodiment of the invention, ceramic balls or spheres are provided with a coating comprising a binder and ceramic particles. The coated ceramic balls are then combined with an aluminum alloy matrix to form lightweight composite armor having improved properties.

Figure 3:
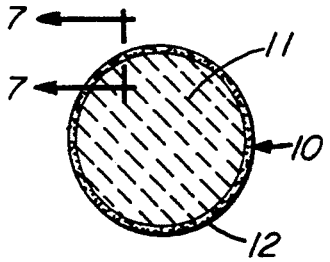
FIG. 3 is an enlarged cross-sectional view of a ceramic ball provided with a coating in accordance with the present invention.

A particularly preferred coated ceramic ball 10 shown in FIG. 3 has a diameter of about one inch (2.54 cm). The coated ball 10 has a core 11 comprising predominantly alpha-alumina. The ceramic balls used herein are manufactured by agglomerating fine particles of alumina into a spherical shape, drying the resulting agglomerates, and then calcining at an elevated temperature above about 1,000° C. The ceramic balls may also be manufactured by hot pressing. The preferred ceramic balls 11 are brittle and extremely hard.

Alumina balls 11 are coated with a pasty suspension of ceramic particles in aqueous sodium silicate solution. The balls may be coated by spraying, dipping, or other preferred coating techniques. A particularly preferred paste is supplied by Foseco Inc. of Brook Park, Ohio under the trademark DYCOTE 39. The paste has a nominal composition of less than 20 wt % barium sulfate particles, greater than 40 wt % titanium dioxide particles, and less than 30 wt % sodium silicate solution. Composition of the ceramic particles may vary widely in both kind and amount. The sodium silicate solution is highly alkaline, preferably with a pH of greater than 10. Aqueous sodium silicate solution is a particularly preferred binder because the solution binds the coating firmly to alumina bodies.

After the coating 12 is applied, the coated balls 10 are dried by heating at about 300°–500° F. (216°–260° C.). For best results, the coating should have a thickness between 30 and 60 mils (0.76–1.5 mm). A coating thickness of about 45 mils (1.1 mm) is particularly preferred.

Figure 7:
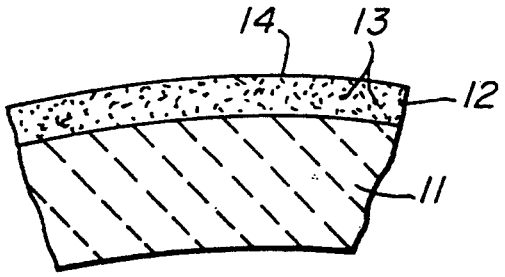
FIG. 7 is an enlarged, fragmentary cross-sectional view taken along the lines 7—7 of FIG. 3.

As shown in FIG. 7, the coating 12 comprises titanium dioxide and barium sulfate particles 13 distributed in a sodium silicate binder 14.

Figure 1:
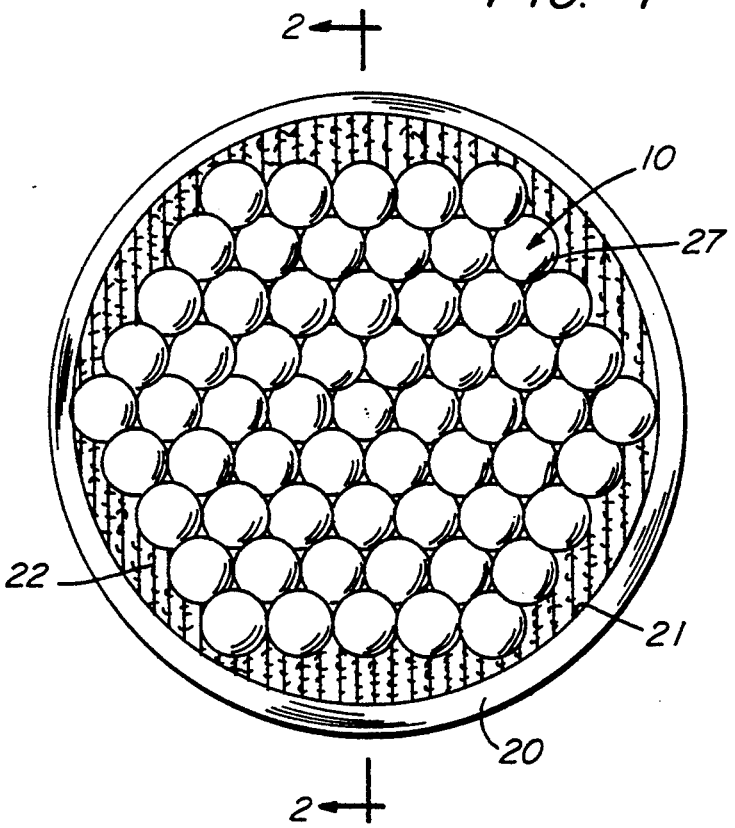
FIG. 1 is a top plan view of an open mold for making composite armor plate in accordance with the present invention.
Figure 2:
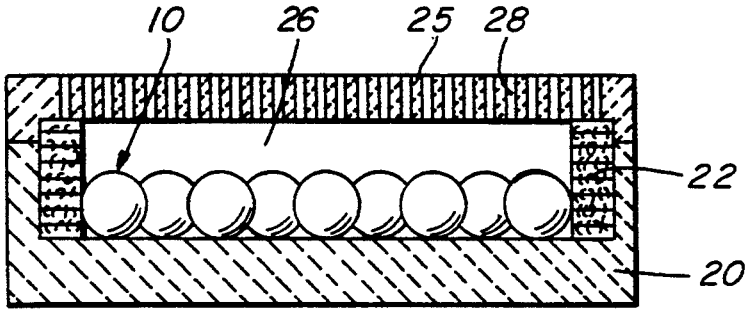
FIG. 2 is a cross-sectional view of a mold for making composite armor plate in accordance with the present invention, taken along the lines 2—2 of FIG. 1.

Referring now to FIGS. 1 and 2, the coated ceramic spheres 10 are placed in close packed arrangement in a graphite mold 20 having a cavity 21 and held together by fibrous insulating material 22 to avoid movement of the spheres 10 during pouring of molten metal. The filled mold 20 is placed in a separate heating furnace and heated to a temperature close to that of incoming molten metal. Preheating before infiltration with molten metal reduces temperature differences between the spheres and metal, thereby minimizing thermal shock and preventing cracking of the spheres. For lightweight armor comprising alumina spheres and an aluminum alloy, the graphite mold 20 was heated to about 800° C. (1472° F.). The heated mold assembly 20 retains heat and prevents the spheres 10 from cooling rapidly during transport from the heating furnace to the die, and also prevents thermal shock to the ceramic spheres due to contact. with the relatively cold die.

Figure 4:
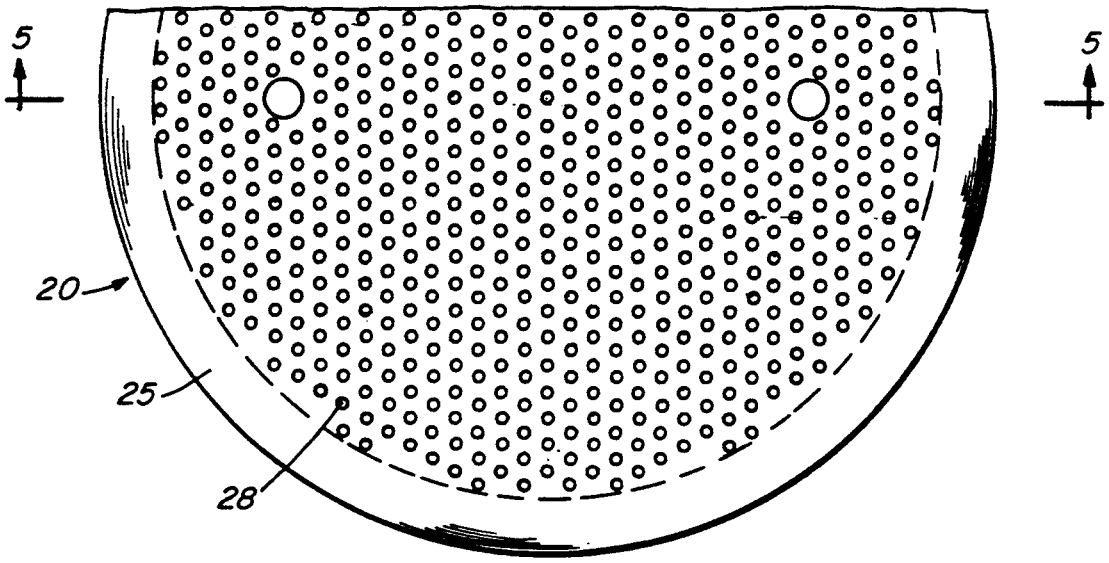
FIG. 4 is a top plan view of a closed mold for making composite armor plate in accordance with the present invention.
Figure 5:
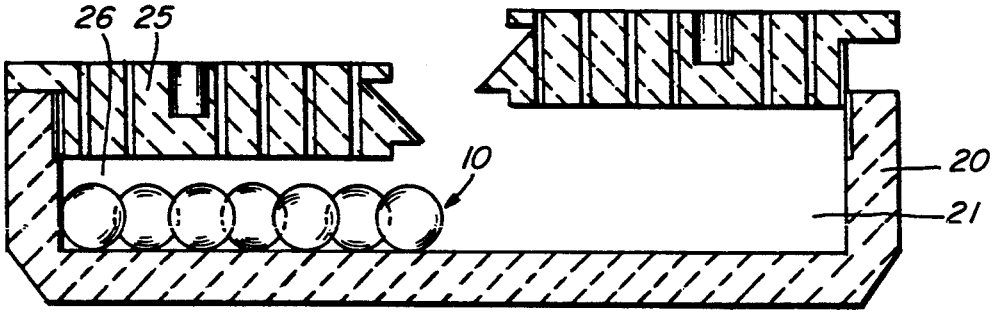
FIG. 5 is a cross-sectional view taken along the lines 5—5 of FIG. 4.

The mold 20 also has a lid 25, as shown in FIGS. 2, 4, and 5. Height of the lid 25 can be adjusted upwardly to add extra metal in a top space 26. The lid 25 has a series of small holes 28, to minimize dangers of oxide or air entrapment and disturbance to the arrangement of spheres 10 by turbulence of incoming molten metal.

Figure 6:
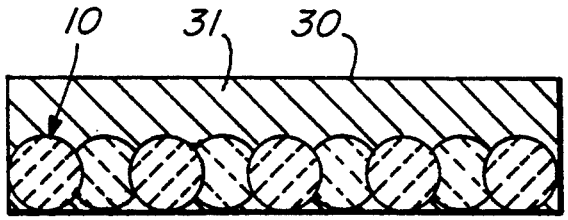
FIG. 6 is a cross-sectional view of a lightweight composite armor plate made in accordance with the present invention.

After the filled mold is placed within a die, molten metal is introduced and allowed to settle within the die. A lightweight composite armor plate 30 made in accordance with the present invention is shown in FIG. 6. The plate 30 comprises alumina spheres 10 and an aluminum alloy matrix 31. In the preferred squeeze casting method described herein, a pressure between about 500 and 10,000 psi is applied to infiltrate the metal into spaces 27 between the spheres 10. The required level of infiltration pressure depends upon size and composition of the spheres 10 and matrix metal. For a combination of an aluminum alloy matrix with one inch diameter alumina balls, a 1,000 psi infiltration pressure is required, and either a die casting or squeeze casting process may be used. While squeeze casting is particularly preferred, other casting processes can be utilized such as die casting, vacuum casting, gravity casting, sand casting, and combinations thereof.

The squeeze casting method permits usage of aluminum alloys designed for wrought products. These alloys include alloys in the 2000, 5000, 6000, and 7000 Series. Alloys of the 6000 Series (Aluminum Association Series) are preferred. Aluminum alloy 6063 was chosen because of its age hardening ability and low quench sensitivity. These properties allow thermal treatment of the aluminum alloy matrix without cracking of the encapsulated alumina spheres during quenching from solution heat treat temperatures.

The coating 12 on the spheres 10 results in an improved product by isolating the spheres and preventing thermal shock waves from degrading the ceramic balls. The product is found to have enhanced ballistic protection and improved multi-hit capabilities.

It has been found that composite armor made with ceramic spheres in an aluminum alloy matrix defeats projectiles at a much lower weight than comparable products utilizing ceramic bodies in the shape of tiles. Ceramic spheres are effective at deflecting projectiles because they present a more oblique surface. It has also been found that ceramic bodies held in compression perform better at defeating projectiles. Encapsulation with a coating in the geometry of a sphere ensures that the ceramic bodies are in compression. Direct impact of a projectile with a ceramic body in compression can break up the projectile into several pieces.

While the invention has been described in terms of preferred embodiments, the claims appended hereto are intended to encompass all embodiments which fall within the spirit of the invention.

What is claimed is:

1. Lightweight composite armor comprising:

(a) a metal matrix comprising an aluminum or titanium alloy, (b) a plurality of ceramic bodies in said metal matrix, and said bodies comprising aluminum oxide, boron carbide, titanium diboride, silicon carbide, or mixtures thereof, and (c) a coating adhered to at least one of said ceramic bodies, said coating comprising:

(1) a binder, and (2) a plurality of ceramic particles.

2. The composite armor of claim 1 wherein said metal matrix comprises an aluminum alloy.

3. The composite armor of claim 2 wherein said aluminum alloy is in the 6000 Series.

4. The composite armor of claim 1 wherein said ceramic bodies comprise alpha-alumina.

5. The composite armor of claim 1 wherein said ceramic bodies are substantially spherical.

6. The composite armor of claim 1 wherein said binder comprises sodium silicate.

7. The composite armor of claim 1 wherein said particles have an average size of less than about 200 microns.

8. The composite armor of claim 1 wherein said particles have an average size of about 1–25 microns.

9. The composite armor of claim 1 wherein said particles comprise titanium dioxide and barium sulfate.

10. The composite armor of claim 1 wherein said coating has a thickness of about 0.76–1.5 mm.

11. The composite armor of claim 1 wherein said ceramic particles comprise alumina, silica, talc, titanium dioxide, barium sulfate, or mixtures thereof.

12. A lightweight composite armor plate comprising:

(a) a metal matrix comprising an aluminum alloy of the 2000, 5000, 6000, or 7000 Series, (b) a plurality of substantially spherical ceramic bodies embedded in said metal matrix, said ceramic bodies comprising alumina, boron carbide, titanium diboride, silicon carbide or mixtures thereof, and (c) a coating adhered to at least one of said ceramic bodies and having a thickness of about 0.76–1.5 mm, said coating comprising:

(1) a sodium silicate binder, and (2) a plurality of ceramic particles having an average size of less than about 200 microns.

13. The composite armor plate of claim 12 wherein said ceramic bodies are alpha-alumina spheres.

14. A method for manufacturing a composite armor plate comprising:

(a) coating a plurality of ceramic bodies with a film comprising a binder and ceramic particles, said bodies comprising aluminum oxide, boron carbide, titanium diboride, silicon carbide, or mixtures thereof, and (b) inserting said plurality of coated ceramic bodies into a mold cavity, (c) casting a molten metal alloy into said mold cavity adjacent said ceramic bodies, thereby to form a composite armor plate.

15. The method of claim 14 wherein said ceramic bodies are substantially sperical.

16. The method of claim 14 wherein said film has a thickness of about 0.76–1.5 mm.

17. The method of claim 14 wherein said film comprises a suspension of ceramic particles having less than 200 microns average size in aqueous sodium silicate solution.

18. The method of claim 14 wherein said molten metal alloy is an aluminum alloy of the 6000 Series.

19. The method of claim 14 further comprising:

(d) cooling said composite armor plate, and (e) removing said composite armor plate from the mold cavity.

20. The method of claim 14 wherein said ceramic bodies comprise alpha-alumina.

* * * * *